US005321954A

United States Patent [19]

Lehman et al.

[11] Patent Number: 5,321,954

[45] Date of Patent: Jun. 21, 1994

[54] STREAMING HEAT EXCHANGER AND APPARATUS FOR AIR DISTILLATION COMPRISING SUCH AN EXCHANGER

[75] Inventors: Jean-Yves Lehman, Maisons-Alfort; Christiane Muller, Viroflay; Frédéric Rousseau, Paris; Cécile Tosi, Sceaux, all of France

[73] Assignee: L'Air Liquide, Societe Anonyme Pour L'Etude et L'Exploitation des Procedes Georges Claude, Paris, France

[21] Appl. No.: 43,798

[22] Filed: Apr. 7, 1993

[30] Foreign Application Priority Data

Apr. 17, 1992 [FR] France ..... 92 04804

[51] Int. Cl.[5] ..... F25J 3/00

[52] U.S. Cl. ..... 62/36; 62/42; 165/166

[58] Field of Search ..... 62/36, 42; 165/166

[56] References Cited

U.S. PATENT DOCUMENTS

| | | | |
|---|---|---|---|
| 3,282,334 | 11/1966 | Stahlheber | 62/36 |
| 3,992,168 | 11/1976 | Toyama et al. | 62/36 |
| 4,599,097 | 7/1986 | Petit et al. | 62/36 |
| 4,721,164 | 1/1988 | Woodward | 62/36 |
| 5,122,174 | 6/1992 | Sunder et al. | 62/36 |
| 5,144,809 | 9/1992 | Chevalier et al. | 62/42 |

FOREIGN PATENT DOCUMENTS 0130122 1/1985 European Pat. Off. .

*Primary Examiner*—Ronald C. Capossela
*Attorney, Agent, or Firm*—Young & Thompson

[57] ABSTRACT

Heat exchanger with streaming liquid to vaporize a liquid by heat exchange with a second fluid, of the type comprising a parallelepipedal body formed form an assembly of parallel vertical plates (4) defining between them a multitude of flat passages (18, 19) distributed in an assembly of vaporization passages (18), and in an assembly of heating passages (19). Each passage contains an undulant-spacer (20) with vertical generatrices. Structure for distribution of the liquid is provided at the upper end of the exchanger (2) to distribute the liquid over all the length of the vaporization passages (18). Structure (9) is provided to direct the second fluid into the heating passages (19). The distribution structure is disposed in compartments (23) closed at their upper end and situated each above a heating passage (19), from which the compartment is separated by a horizontal strip (22). A horizontal slot (34) extends over all the length of the exchanger, to just above the strip (22), and places the lower portion of the compartment (23) in free communication with an adjacent vaporization passage (18). The vaporization passages (18) are open at their upper and lower ends, over all their length, and contain at most one undulant-spacer (20A) with vertical generatrices.

12 Claims, 2 Drawing Sheets

STREAMING HEAT EXCHANGER AND APPARATUS FOR AIR DISTILLATION COMPRISING SUCH AN EXCHANGER

The present invention relates to a streaming liquid heat exchange to vaporize a liquid by heat exchange with a second fluid, of the type comprising a parallelepipedal body formed from an assembly of parallel vertical plates defining between them a multitude of flat passages divided into an assembly of vaporization passages and an assembly of heating passages, each passage, in its heat exchange flow portion, containing a corrugated spacer with vertical generatrices, distribution means for the liquid being provided at the upper end of the exchanger to distribute the liquid over all the length of the vaporization passages, and means to send the second fluid into the heating passages. It is applicable particularly to air distillation apparatus.

In the air distillation apparatus of the double column type, liquid oxygen which is in the base of the low pressure column is vaporized by heat exchange with the gaseous nitrogen at the head of the medium pressure column. For a given operating pressure of the low pressure column, the temperature difference between the oxygen and the nitrogen rendered necessary by the structure of the heat exchanger, dictates the operating pressure of the medium pressure column. It is thus desirable that this temperature difference be as small as possible, so as to minimize the costs involved in the compression of the air to be treated and injected into the medium pressure column.

To achieve this object by benefiting from the very advantageous technology of heat exchangers with brazed plates, EP-A-130 122 in the name of the applicant has proposed a particularly effective manner of distribution of the liquid oxygen.

However, no matter what the distribution method adopted, the present technology is subject to certain limits. These latter are due to the fact that, although the liquid oxygen is at a pressure which is only slightly greater than atmospheric pressure, the gaseous oxygen resulting from the vaporization must leave through the exchanger. The pressure drop by passage of the gaseous oxygen must therefore be very low. In all the known arrangements, this constraint limits the height of the exchanger, and more generally its performance.

The invention has for its object to permit increasing the height of such a heat exchanger or, for a given height, reducing the pressure drop during flow of the vaporized oxygen. To this end, it has for its object a heat exchanger of the recited type, characterized in that said distribution means are disposed in compartments closed at their upper end and each located above a heating passage, from which it is separated by a horizontal strip, in that a horizontal slot, extending over all the length of the exchanger, just above the strip, places the lower part of the compartment in free communication with an adjacent vaporization passage, and in that the vaporization passages are open at their two upper and lower ends over all their length and contain more than one undulant spacer with vertical generatrices over all their length.

According to other characteristics:

the vaporization passages are free from any undulant spacer facing the slots;

the upper surface of the strip is inclined laterally towards the slot;

distribution means for the liquid comprise, on the one hand, a horizontal bar extending over all the length of each compartment, at an intermediate level of this latter, this bar having a thickness equal to the mutual spacing of the plates and comprising openings for predistribution of the liquid, and on the other hand, below this bar, a packing for fine distribution of the liquid over all the horizontal length of the compartment;

said openings form a horizontal row of holes equidistant from each other;

the bar comprises on one vertical surface one or several rear recesses closed downwardly and open upwardly and on its other vertical surface one or several recesses open downwardly and closed upwardly, and in that said openings are provided through a vertical wall common to the forward and rear recesses;

the bar comprises several rear recesses spaced from each other, and several forward recesses spaced from each other;

the forward recesses have a downwardly flaring shape;

the packing is an undulant member with horizontal generatrices whose ends are provided with bends;

the packing is spaced from the upper surface of the strip;

the exchanger comprises a lateral inlet box for liquid into its compartments, the lowermost point of this box being located below the lowermost point of the inlet window of these compartments.

The invention also has for its object an apparatus for the separation of air by distillation, of the type comprising a first distillation column operating under a relatively high pressure, a second distillation column operating under a relatively low pressure, and a heat exchanger permitting placing the liquid oxygen in the base of the second column in heat exchange relataion with the gaseous nitrogen at the head of the first cloumn, characterized in that the heat exchanger is as defined above, and in that the installation comprises supply means to provide the liquid oxygen to said liquid distribution means, and means for supplying the heating passages with gaseous nitrogen.

Examples of operation of the invention will now be described will regard to the accompanying drawings. In these drawings.

Figure 1:
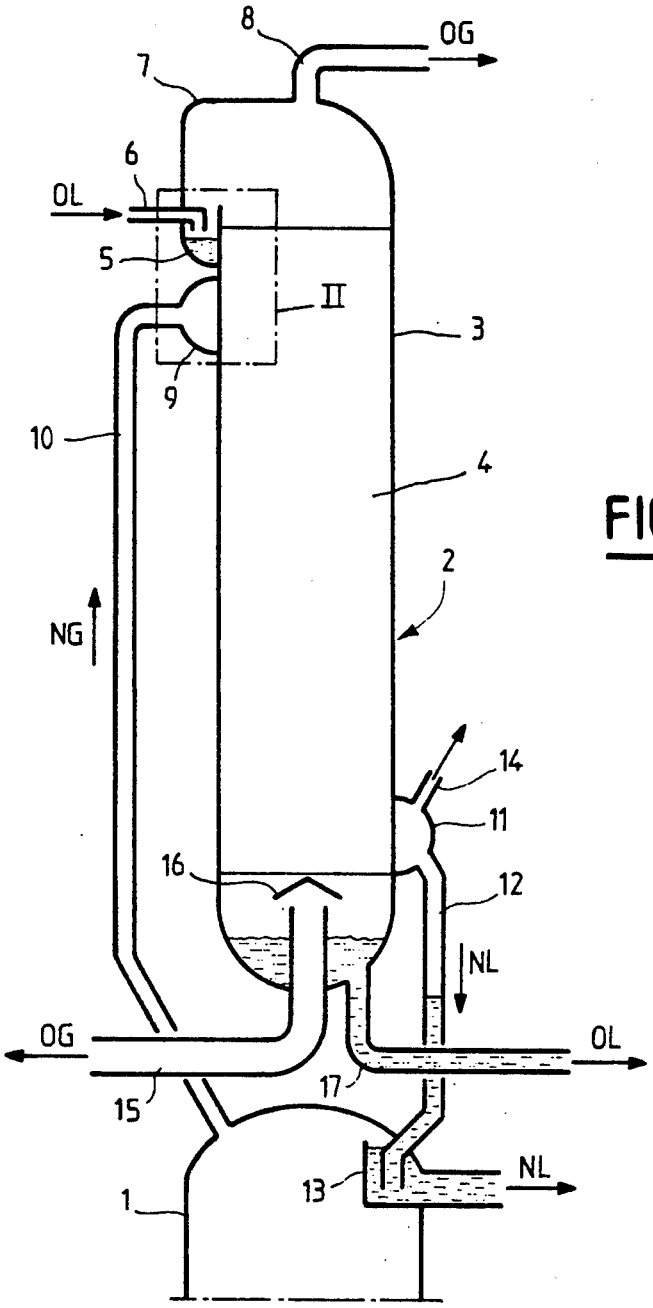
FIG. 1 is a partial schematic view of an air distillation apparatus according to the invention.

FIG. 1 shows a possibility of implementation of an oxygen-nitrogen heat exchanger in an air distillation apparatus of the double column type. This apparatus comprises a medium pressure column 1 at the base of which is injected the air to be treated, under a pressure of the order of 6 bars absolute. The liquid enriched in oxygen which collects in the base of column 1 is sent as reflux intermediate the height of a second column (not shown), called a medium pressure column, which operates slightly above atmospheric pressure. The gaseous nitrogen which collects in the head of column 1 is placed in indirect heat exchange relation with the liquid oxygen collected in the base of the low pressure column; the resulting condensed nitrogen serves as reflux in the column 1 and in the low pressure column, while the resultant vaporized oxygen is returned to the base of the low pressure column.

The two distillation columns can particularly be of the packed type, which also contributes to an energy saving by reduction of the operating pressure of the apparatus, which is that of column 1.

The heat exchange between the oxygen and the nitrogen takes place in an exchanger 2 which is mounted above the column 1, while the low pressure column is juxtaposed to this latter.

The exchanger 2 is constituted by a sealed casing 3 which over most of its height contains an assembly of parallel plates 4 of rectangular shape, of aluminum, of a length of about 1 to 1.5 meters and a height of about 3 to 7 meters, between which the undulations also of aluminum are secured by brazing.

A space under a pressure slightly greater than that of the low pressure column (for example of the order of 1.4 bar), located at the level of the upper end of the plates 4, facing one of their vertical sections, encloses a bath 5 of liquid oxygen supplied by a shower from a conduit 6 proceeding from the base of the low pressure column and provided with a pump (not shown). This latter can be controlled by a regulator of the level of bath 5, or, as a modification, by a flow rate regulator. At the summit of the exchanger 2, the casing 3 forms a dome 7 which contains the bath 5. From this dome leaves a conduit 8 for resending to the base of the low pressure column the vaporized oxygen from the bath 5, resulting from the entry of heat into the pump and the piping, and of a part of the oxygen vaporized in the exchanger 2.

The assembly of plates 4 is supplied at its upper portion with gaseous nitrogen under 6 bars by a horizontal supply box 9, located below the bath 5, which communicates by a conduit 10 with the head of the medium pressure column. Removal of the condensed oxygen is effected at the bottom of the plates 4 by a horizontal collector box 11 which communicates via a conduit with a sheltered trough 13 disposed at the head of the column 1. To the box 11 is connected a pipe 14 for evacuation of the incondensable rare gases.

A conduit 15 connects the bottom of the pressure column with the space located in the casing 3, below the plates 4. This conduit enters vertically into this space through the lowermost part of the casing 3, and its upper end is surmounted with a conical deflector 16. From the base of the casing 3 also leaves a conduit 17 adapted to return to the bottom of the low pressure column excess liquid oxygen.

Figure 4:
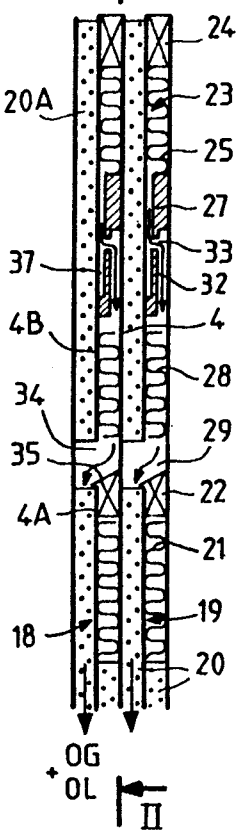
FIG. 4 is a cross-sectional view on line IV—IV of FIG. 2.
Figure 2:
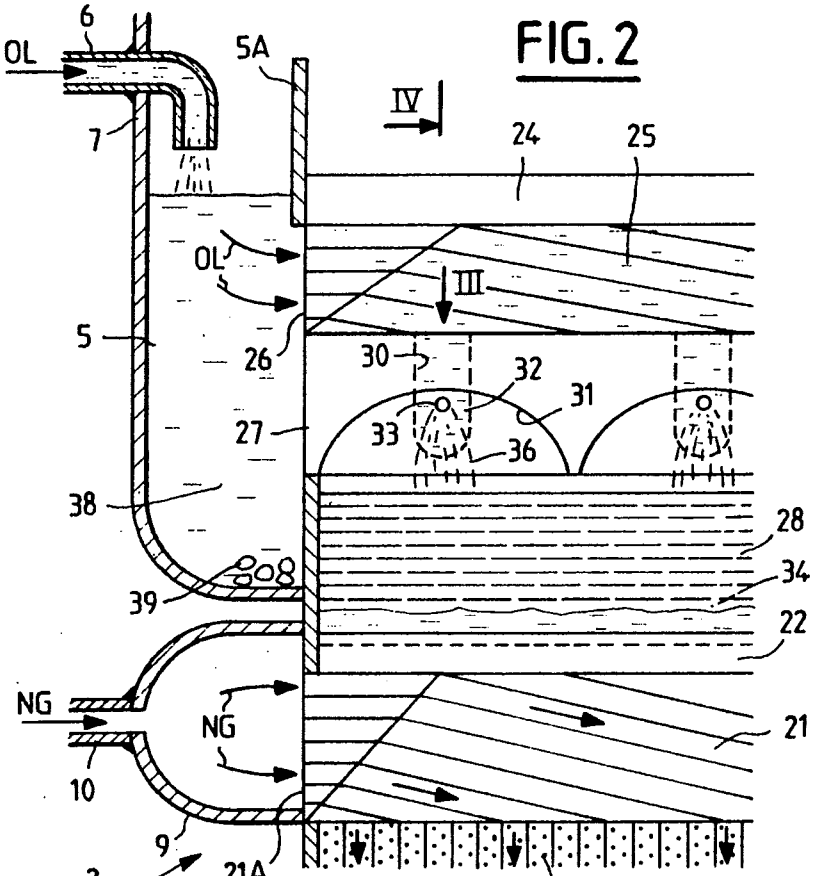
FIG. 2 shows in vertical cross section, on an enlarged scale, the region II of FIG. 1, the section being taken on the line II—II of FIG. 4.
Figure 3:
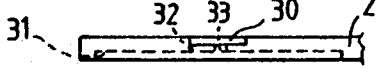
FIG. 3 is a fragmentary plan view taken in the direction of arrow III of FIG. 2.

The structure of the active portion of the exchanger 2, which is to say the assembly of plates 4, will now be described with respect to FIG. 2–4.

In this region, the exchanger has a parallelepipedal shape, and a casing 3 is defined by the sections of the plates 4 and by the strips-spacers which close the passages that these plates define, except at the positions of the inlet and outlet of the fluids. The plates 4 define a multitude of passages adapted alternatively to the flow of oxygen (pasaages 18) and to the flow of nitrogen (passages 19). Over the major portion of their height, the passages 18 and 19 each contain an undulant-spacer 20 constituted by an undulant perforated aluminum sheet with vertical generatrices.

The undulations 20 of the nitrogen passages terminate upwardly as well as downwardly, in front of the undulations 20 of the oxygen passages. Below the plates 4, these undulations of the passages 19 are prolonged by oblique undulations for the collection of nitrogen (not shown) which terminate at the inlet of the collector box 11. At their upper end, these same undulations 19 are prolonged by oblique undulations 21 for distribution of nitrogen which terminate, by a lateral window 21A of the exchanger, at the outlet of the supply box 9. Above the undulations 21, the nitrogen passages 19 are closed by horizontal strips 22. Other horizontal strips (not shown) close the lower end of the nitrogen passages below the collection regions for nitrogen. Above the strips 22, each nitrogen passage is prolonged by a compartment 23 for distribution of liquid oxygen closed at the upper end of the exchanger by a horizontal strip 24. The compartment 23 contains, from top to bottom: an oblique undulant-spacer 25 (or, as a modification, a perforated undulation with horizontal generatrices) for rough distribution of the liquid oxygen over all the length of the compartment, this undulation terminating laterally, via a lateral window 26 of the exchanger, in the bath 5 (FIG. 2); a perforated bar 27 for predistribution of liquid oxygen; and a packing 28 for fine distribution of liquid oxygen. A free space 29 is provided between this packing and the upper surface of the strip 22.

The bar 27 is machined from a parallelepipedal blank whose thickness is equal to the spacing between the plates 4, namely of the order of 5 to 15 mm, and whose length is equal to that of these plates. In one of its major faces are machined a series of rear recesses (having regard to FIG. 2) 30 which are U shaped, opening upwardly, and in its other surface are machined a series of forward recesses 31 which are substantially semi-circular, opening downwardly. Each recess 31 is located in longitudinal coincidence with a recess 30 and overlaps the latter in height, such that there exists, at about mid-height of the bar (FIG. 4), a thin vertical wall 32 common to the two recesses. This wall is pierced by a circular hole 33. The holes 33 are spaced at regular intervals along the bar 27.

The packing 28 is constituted by an undulation with horizontal generatrices (an arrangement called "the hard way" relative to the flow of liquid oxygen) which are not perforated but of the "serrated" type. This means that at regular intervals, each horizontal or pseudohorizontal facet of the undulation is provided with a dent offset upwardly by a quarter of the pitch of the undulation. The width of the width of the dents, measured along a generatrix of the undulation, is of the same order as the distance which separates from each other the two adjacent dents located on the same facet.

The passages 18 for vaporization of oxygen are open at their upper and lower ends. They contain the undulation 20 of the lower end to the level of the strips 22, are free from any undulation facing the space 29, then, from the upper level of this space 29 to their upper end, they contain another undulant-spacer 20A analogous to undulation 20 but of a greater pitch. The region of each passage 18 free from undulation communicates freely with a space 29 of an adjacent passage 19 through a horizontal slot 34 of the same height extending over all the length of the exchanger. Thus, one plate 4 out of two is continuous over all the extent of the exchanger, while one plate out of two is in fact constituted by a rectangular plate 4A which extends upwardly only to the strip 22, and by a rectangular plate 4B which delimits the compartment 23 for distribution of liquid oxygen. The upper surface 35 of the strip 22 is inclined laterally to slope downward from the adjacent plate 4 to the upper edge of the confronting plate 4A. Thanks to an overhang of the strip 22, this surface extends slightly beyond the surface of the plate 4A which delimits the passage 18.

In operation, the liquid oxygen bath 5 is maintained at a substantially constant level, without rising above the upper surface of a vertical plate 5A soldered on the exchanger above the windows 26. Thus, the liquid oxygen penetrates laterally into the compartments 23, by one of their ends through the windows 26. Simultaneously the gaseous nitrogen under 6 bars absolute enters the upper portion of the passages 19, through one end of these passages, via the box 9 and the distribution undulations 21.

The liquid oxygen thus forms a column of liquid of substantially uniform height above all the holes 33. It is predistributed over all the length of the passages 18 in a certain number of jets 36 through these holes 33, then falls freely on the packing 28, which, because of its construction and its arrangement, ensures a fine distribution of the liquid oxygen over all the length of the passages 18. The liquid oxygen therefore falls uniformly on the inclined surface 35 of the strips 22, then flows through the slots 34 into the passages 18.

A film of liquid oxygen thus streams over all the metallic surfaces contained in the passages 18, which is to say on the plates 4 and 4A and on the undulations 20, and it vaporizes partially by indirect heat exchange with the nitrogen in the course of condensation downwardly within the alternating passages 19.

As indicated above, the passages 18 are open not only upwardly and downwardly, but are also free to the maximum, over all their height, from obstacles to the flow of gaseous oxygen. Thus, at no matter what point along their height, these passages are either empty (facing the slot 34), or provided with a simple undulation 20, 20A with vertical generatrices and of relatively great pitch. The undulation 20 improves the heat exchange with the nitrogen by a fins effect, while the undulation 20A serves only as a spacer and can even if desired be partially omitted.

As a result of this, a portion of the vaporized oxygen can leave the exchanger upwardly and therefore add, in the upper dome 7, to the evaporation of the bath 5 (FIG. 1), the rest of the vaporized oxygen leaving the exchanger downwardly at the same time as the excess liquid oxygen and then leaving via the conduit 15. The two outlet paths of the vaporized oxygen are traversed by a reduced gaseous flow, and each path imposes moreover a minimum pressure drop for the flow of this gas. Finally, the height of the exchanger can be increased.

It is to be noted that, thanks to the structure of the bars 27, the holes 33 have horizontal axes and there exists a dead space 37 on the rear surface of the bar, below these holes. Possible solid impurities contained in the liquid oxygen can thus deposit in these dead spaces, which protects the holes 33 against the risk of blockage.

Similarly, the configuration of the casing 3 in the region of the liquid oxygen bath 5 provides a dead space 38 adjacent to inlet windows 26 and located below these latter, which permits the largest solid impurities to decant into this dead space, when leaving the supply conduit 6, as indicated at 39 in FIG. 2.

Figure 5:
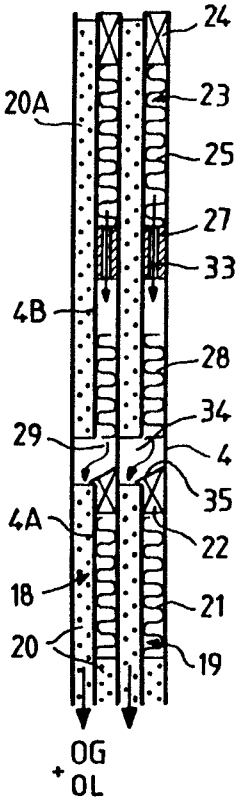
FIG. 5 is a similar view of a modification.

If, according to a particular application, this decantation is deemed sufficient to avoid any risk of blocking of the holes 33, recourse can be had to the modification of FIG. 5. This latter differs from the preceding only by the simplified construction of the bar 27, which is a simple bar of rectangular cross section provided at regular intervals with holes 33 on vertical axes. These holes can have an enlarged diameter over the major portion of their height from the bottom, as explained in EP-A-0 130 122 cited above.

What is claimed is:

1. In a heat exchanger with streaming liquid to vaporize a liquid by heat exchange with a second fluid, comprising a parallelepipedal body formed from an assembly of parallel vertical plates (4) defining between them a multitude of flat passages (18, 19) distributed in an assembly of vaporization passages (18), and in an assembly of heating passages (19), each passage containing an undulant-spacer (20) with vertical generatrices, means for distribution of the liquid at the upper end of the exchanger (2) to distribute the liquid over all the length of the vaporization passages (18), and means (9) to direct the second fluid into the heating passages (19); the improvement wherein said distribution means are disposed in compartments (23) closed at their upper end and situated each above a heating passage (19) from each said compartment (23) is separated by a horizontal strip (22), there being a horizontal slot (34) that extends over all the length of the exchanger, to just above the strip (22), and that places the lower portion of the compartment (23) in free communication with an adjacent vaporization passage (18), the vaporization passages (18) being open at their upper and lower ends, over all their length, and containing at most one undulant-spacer (20A) with vertical generatrices.

2. Exchanger according to claim 1, wherein the vaporization passages (18) are free from any undulant-spacer facing the slots (34).

3. Exchanger according to claim 1, wherein the upper surface (35) of the strip (22) is inclined laterally downwardly toward the slot (34).

4. Exchanger according to claim 1, wherein the liquid distribution means comprise a horizontal bar (27) extending over all the length of each compartment, at an intermediate level of the compartment, this bar having a thickness equal to the mutual spacing of the plates (4) and comprising openings (33) for predistribution of the liquid, and below this bar, a packing (28) for fine distribution of the liquid over all the horizontal length of the compartment (23).

5. Exchanger according to claim 4, wherein said openings (33) form a horizontal row of holes equidistant from each other.

6. Exchanger according to claim 4, wherein the bar (27) comprises on one vertical surface at least one rear recess (30) downwardly closed and upwardly open and on an opposite vertical surface at least one forward recess (31) downwardly open and upwardly closed, and a said opening (33) extending through a vertical wall (32) common to said forward and rear recesses.

7. Exchanger according to claim 6, wherein the bar (27) comprises several rear recesses (30) spaced from each other, and several forward recesses (31) spaced from each other.

8. Exchanger according to claim 7, wherein the forward recesses (31) have a downwardly flared shape.

9. Exchanger according to claim 4, wherein the packing (28) is an undulation with horizontal generatrices whose ends are provided with bends.

10. Exchanger according to claim 4, wherein the packing (28) is spaced from the upper surface (35) of the strip (22).

11. Exchanger according to claim 1, which further comprises a lateral inlet box for liquid in said compartments (23) the bottom of this box being located below the bottom of an inlet window (26) of these compartments.

12. Installation for the separation of air by distillation, comprising a first distillation column (1) operating under a relatively high pressure, a second distillation column operating under a relatively low pressure, and a heat exchanger (2) according to claim 1 placing liquid oxygen in the base of the second column in heat exchange relation with gaseous nitrogen in the head of the first column, supply means (6) to supply liquid oxygen to said liquid distribution means, and means (9) for supplying the heating passages with gaseous nitrogen.

* * * * *